US005183393A

United States Patent [19]

Schaffner

[11] Patent Number: 5,183,393

[45] Date of Patent: Feb. 2, 1993

[54] POWER LIMITER CONTROL FOR A VARIABLE DISPLACEMENT AXIAL PISTON PUMP

[76] Inventor: Larey D. Schaffner, 7770 Witherspoon Dr., Baltimore, Ohio 43105

[21] Appl. No.: 832,965

[22] Filed: Feb. 10, 1992

[51] Int. Cl.[5] ..... F04B 1/26

[52] U.S. Cl. ..... 417/218; 417/222.1

[58] Field of Search ..... 417/218, 219, 222 R

[56] References Cited

U.S. PATENT DOCUMENTS

| | | | |
|---|---|---|---|
| 3,820,920 | 6/1974 | Klimaszewski | 417/218 X |
| 4,132,506 | 1/1979 | Dantlgraber | 417/218 |
| 4,468,173 | 8/1984 | Dantlgraber | 417/222 R |

FOREIGN PATENT DOCUMENTS

| | | | |
|---|---|---|---|
| 78861 | 5/1983 | European Pat. Off. | 417/218 |
| 226125 | 6/1987 | European Pat. Off. | 417/218 |
| 131891 | 8/1982 | Japan | 417/218 |
| 2042219 | 9/1980 | United Kingdom | 417/218 |

*Primary Examiner*—Leonard E. Smith
*Attorney, Agent, or Firm*—Thomas S. Baker, Jr.

[57] ABSTRACT

A power limiter control for a variable displacement axial piston pump monitors systems flow and automatically adjusts pump displacement proportionally as the pressure of working fluid changes to maintain a substantially constant power output as the working fluid output reaches a set maximum power.

2 Claims, 1 Drawing Sheet

POWER LIMITER CONTROL FOR A VARIABLE DISPLACEMENT AXIAL PISTON PUMP

BACKGROUND OF THE INVENTION

In many applications an axial piston hydraulic pump driven by an electric motor will be utilized to drive a hydraulic device such as a motor or cylinder to operate a machine. A machine such as a press or a shear will be utilized to crush a can, cut a piece of metal or otherwise process a workpiece. Such machines typically operate in two different modes. In the first mode the hydraulic driving motor would be operated at a relatively high speed to move the compression ram or cutting jaws into contact with a workpiece. In the second mode the ram or jaws contact the workpiece and the hydraulic driving motor speed would decrease as the system pressure increases and the motor reaches a set maximum power output.

In the first mode the fluid output of the hydraulic pump to the hydraulic motor initially would have a relatively high flow rate and be at relatively low pressure. During the second mode when the machine demands full power and fluid pressure increases the displacement of the pump would be reduced proportionally to maintain a constant power output.

In some instances the hydraulic system may demand more power than the electric motor is capable of delivering. When this occurs the electric motor becomes overloaded. If an electric motor operates in an overloaded condition for an extended period of time it may experience a premature failure. Consequently, it becomes desirable to automatically adjust the high and low flow rates of the working pressure fluid and to limit the power output from a hydraulic pump when it is driving a working device.

Pump horsepower may be determined by multiplying a constant by the flow rate and the pressure of the working fluid output by the pump. Some previous devices have attempted to maintain a constant horsepower output of a pump by mechanically linking the displacement control of the pump with a device which sets the maximum outlet pressure for the pump. These devices suffer from the disadvantage that pump power cannot be controlled by monitoring system flow at a location remote from the pump.

Thus, it becomes desirable to provide a power limiter control for a variable displacement axial piston pump which maintains a constant power output of the pump by monitoring system flow without regard to the setting of the displacement control for the pump.

SUMMARY OF THE INVENTION

The subject invention provides a power control for a variable displacement pressure compensated axial piston pump having an inlet and an outlet, a fixed orifice in the outlet for establishing a pressure differential proportional to outlet flow from the pump, a movable swash plate and a movable control piston attached to the swash plate for setting the displacement of the pump movable between a first control position of maximum pump displacement and a second control position of minimum pump displacement and a spring for spring biasing the control piston towards the first position. The torque control has a housing having a first bore for receiving a compensator metering piston, a tank port adapted to be connected to tank which opens into the first bore, an outlet pressure port adapted to be placed in fluid communication with the outlet of the pump which opens into the first bore and a control port adapted to be connected to the control piston which opens into the first bore. A compensator metering spool is slideably received within the first bore. The spool has a land and is movable between a first spool position in which the outlet pressure port is in fluid communication with the control port such that outlet pressure fluid is directed to the control piston to move the control piston toward the second control position, a second spool position in which the tank port is in fluid communication with the control port such that pressure fluid is drained from the control piston to enable that the spring means to bias the control piston towards the first control position and an intermediate position in which the control port is blocked by the land. A compensator spring means mounted in the housing biases the compensator metering spool towards the second spool position. A flow port formed in the housing is in fluid communication with the downstream side of the fixed orifice in the outlet and with the metering spool. A first fixed orifice is in fluid communication with the outlet pressure port and the flow port which creates a first pressure differential across the metering spool which opposes the force of the compensator spring means to establish a minimum flow setting when the pump is operating. A pressure responsive valve is in fluid communication with the first fixed orifice and the flow port. The pressure responsive valve moves between a closed valve position which fluid flow between the outlet pressure port and the flow port is prevented, a fully opened valve position in which maximum fluid flow between the outlet pressure port and the flow port occurs such that the metering spools exposed to the entire pressure differential across the fixed orifice in the outlet port and intermediate positions between the closed position and the fully open valve position when the pump is operating. A second spring means biases the pressure responsive valve toward the closed valve position and the second spring means is set for a pressure at maximum flow at the outlet. The pressure responsive valve moves to the intermediate position when the outlet pressure reaches the maximum set pressure to modulate fluid flow between the outlet pressure port and the flow port to modulate the pressure differential across the metering spool to cause the metering spool to move between the first and second spool positions. This causes the control piston to move between the first and second control positions to thereby cause pump displacement to vary proportionally to outlet pressure to maintain a constant power output from the pump. A pressure compensator means is in fluid communication with the first fixed outlet to limit the maximum pressure of the fluid in the outlet.

DESCRIPTION OF THE PREFERRED EMBODIMENT

Figure 1:
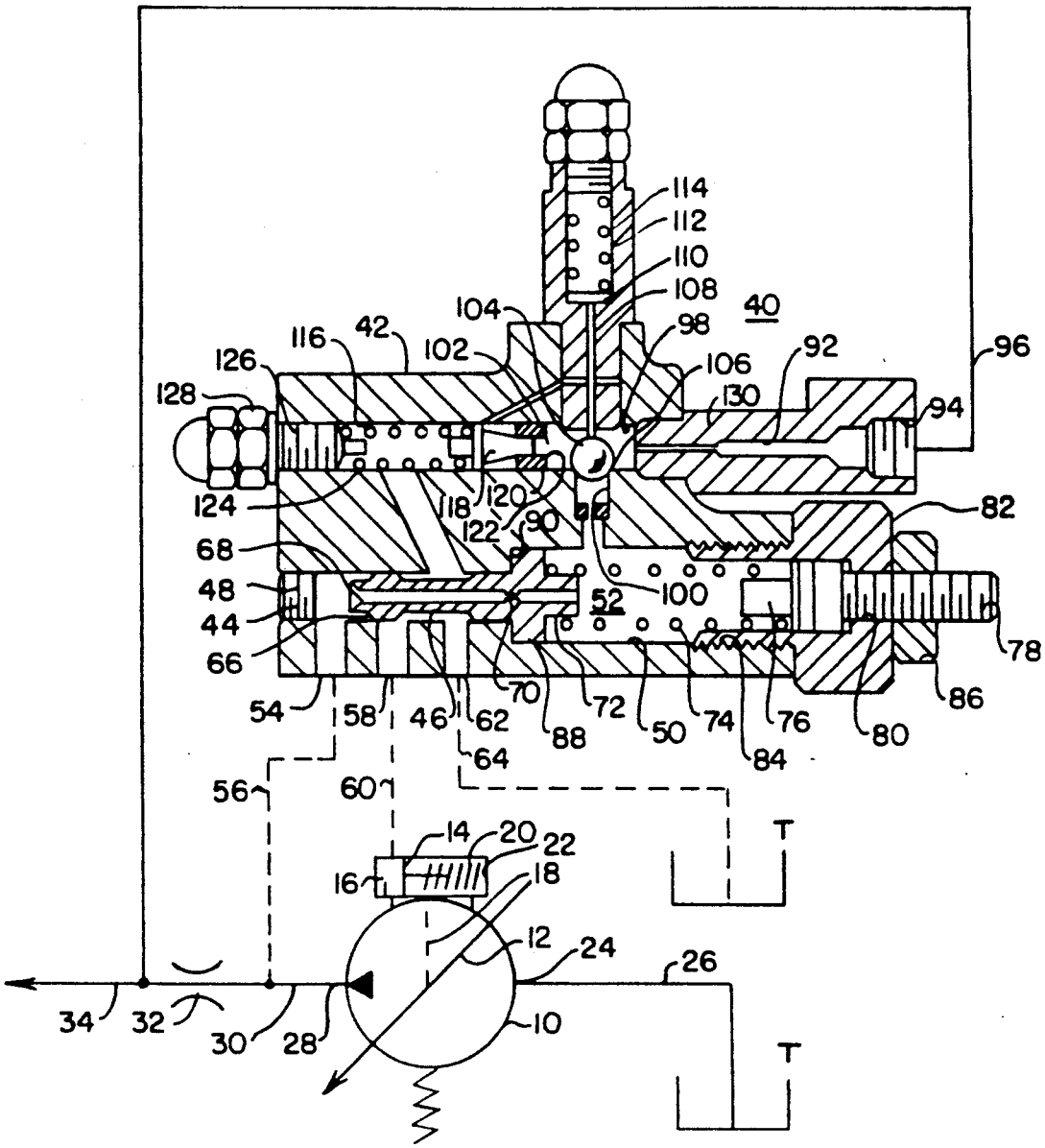
FIG. 1 is a sectional view of a power control shown connected to a variable displacement axial piston pump having a control piston spring biased to the maximum displacement position.

Turning to FIG. 1, a variable displacement pressure compensated axial piston pump (10) has a pivotal swash plate (12) which sets the displacement of the pump in a well known manner. Conventionally, an electric motor, not shown, rotates a pump barrel containing a plurality of pistons in cylinder bores which reciprocate to pump fluid. One end of each piston slides on the face of swash plate (12) causing the pistons to reciprocate in the piston bores when the face of swash plate (12) is non-perpendicular to the access of the piston bores. When swash plate (12) is aligned perpendicular to the piston bores the pump is at a position of minimum fluid displacement and when swash plate (12) is rotated such that the face thereof is at a maximum angle with respect to the piston bores the pump is at a position of maximum fluid displacement. Such variable displacement swash plate axial piston pumps are conventional and are well known in the art.

Swash plate (12) is moved between positions of minimum and maximum pump displacement by a control piston (14) movable in a bore (16) and connected to swash plate (12) by means of a linkage (18). A spring (20) acts against one end (22) of cylinder bore (16) and control piston (14) to bias the piston (14) in a direction which pivots swash plate (12) to a position of maximum pump displacement. Pump (10) has an inlet (24) through which it receives fluid from a tank T through a line (26). Pump (10) discharges pressure fluid through an outlet (28) into a line (30) to drive a fluid motor, cylinder or other device in a conventional manner.

It should be noted that a fixed orifice (32) is installed in line (30) at the outlet (28) of pump (10). Orifice (32) may be located a substantial distance such as ten meters from pump (10) if necessary. Fixed orifice (32) functions to provide a pressure drop between line (30) upstream of orifice (32) and line (34) downstream of orifice (32) proportional to the volume of fluid flowing through orifice (32). The function of orifice (32) will be described hereinbelow. Power limiter control (40) has a housing (42) containing a bore (44) which receives a slideable compensator metering spool (46). A plug (48) closes one end of bore (44) whereas the other end of bore (44) opens into an enlarged bore (50) which defines a spring cavity (52). Housing (42) has an outlet pressure port (54) which opens into bore (44) and connects to outlet line (30) of pump (10) through line (56), a control port (58) which opens into bore (44) and connects to control piston bore (16) through line (60) and a tank port (62) which opens into bore (44) and connects to tank T through line (64).

The compensator metering spool (46) has a metering land (66), a through axial bore (68) which contains a fixed orifice (70) and a cylindrical post (72) which projects into spring cavity (52). A spring (74) which occupies spring cavity (52) overlies cylindrical post (72) of metering spool (46) and one end (76) of an adjustment screw (78) to apply a force to spool (46). Adjustment screw (78) is threadably received within a threaded bore (80) of a cap (82) which is screwed into a threaded portion (84) of bore (50) to close one end of spring cavity (52). Adjustment screw (78) is retained in position by a lock nut (86).

It may be observed that spring (74) biases metering spool (46) to the left as viewed in FIG. 1 until an enlarged land (88) on one end of spool (46) engages a wall (90) defining the bottom of bore (50). In this position of compensator metering spool (46) control port (58) is connected to tank port (62). Thus, spring (20) is free to bias control piston (14) into a position of maximum pump displacement. Metering spool (46) moves to the right when working pressure fluid from the outlet (28) of pump (10) enters outlet pressure port (54) and flows through axial bore (68) and orifice (70) within spool (46) and creates a pressure differential sufficient to overcome the force of spring (74). When this occurs spool (46) may move to a position in which land (66) substantially blocks control port (58) to maintain the position of control piston (14) or to a position in which control port (58) is open to outlet pressure port (54) and outlet pressure fluid enters to cause control piston (14) to move to the right to pivot swash plate (12) to reduce the displacement of pump (10). The operation of metering spool (46) to reduce the displacement of pump (10) will be described in greater detail hereinbelow. It should be noted that orifice (70) need not be within spool (46). The fixed orifice (70) may be located anywhere in the flow path between outlet pressure port (54) and spring cavity (52).

Housing (42) contains a bore (92) one end of which opens into a flow port (94) connected to the downstream side of orifice (32) at line (34) through line (96). Bore (92) is in fluid communication with spring chamber (52) and axial bore (68) in metering spool (46) through bores (98 and 100). In this manner working pressure fluid downstream of orifice (32) is in fluid communication with the end of compensator metering spool (46) which projects into spring cavity (52) whereas working pressure fluid upstream of orifice (32) is applied to metering spool (46) through outlet pressure (54). Because the pressure of the working pressure fluid downstream of orifice (32) is less than that of the working pressure fluid upstream of orifice (32) working pressure fluid flows through axial bore (68) in metering spool (46) and creates a pressure differential across the spool as it passes through fixed orifice (70). As mentioned previously, this pressure differential will cause spool (46) to move to the right when it becomes sufficient to overcome the force applied by spring (74) and that of the fluid in spring cavity (52).

The intersection of bores (98 and 100) define a cavity (102) containing a ball (104) which occupies a seat (106) defined by one end of bore (100). Ball (104) and seat (106) cooperate to form a variable orifice. A rod (108) attached to a piston (110) movable within a bore (112) is moved downwardly under the influence of a spring (114) to cause ball (104) to remain in contact with seat (106). In this position ball (104) closes bore (100), pressure fluid is prevented from flowing through axial bore (68) of metering piston (46) thus preventing a pressure differential from acting on spool (46) thereby preventing the spool (46) from acting in response to the flow of fluid from the outlet (28) of pump (10) through orifice (32). Spring (114) in concert with rod and piston assembly (108 and 110) function to prevent the operation of compensator metering spool (46) until working pressure fluid output from the pump at outlet (28) reaches a desired set pressure. This pressure would be determined by spring (114). In this manner, pump (10) operates at an initial set displacement which may be the maximum displacement setting for the pump until the pressure of the working fluid reaches a set level. This pressure setting is at a maximum set power for the pump. Thus, the pressure and flow of the working fluid are at the maximum set power desired from the pump. When the pressure of the working fluid attains the set pressure, ball (104) lifts from seat (106) to modulate fluid flow between the outlet pressure port and the flow port. This modulates the pressure differential across metering spool (46) to cause the spool (46) to move between a first position in which outlet pressure port (54) connects to control port (58) and a second position in which tank port (62) connects to control port (58). This causes control piston (14) to move and to vary pump displacement proportionally to outlet pressure to maintain a constant power output from the pump. In other words, the power limiter control (40) functions to reduce the displacement of the pump proportionally as the working fluid pressure increases to maintain a substantially constant power output for the pump.

A bore (116) containing a cone (118) and a seat (120) with a central bore (122) opens into cavity (102). A spring (124) having one end seated on cone (118) and the other end seated against an adjustment screw (126) biases cone (118) to seal bore (122) of seat (120). A lock nut (128) secures the position of adjustment screw (126). Spring (124) and cone (118) are a pressure compensator assembly which set the maximum allowable pressure for working fluid output at (28) from pump (10). When the pressure of the working fluid reaches the setting of spring (124) cone (118) is withdrawn from seat (120) and bore (122) is opened. This provides a path for fluid in spring chamber (52) and bores (98 and 100) to flow to tank thereby increasing the pressure drop across orifice (70) in metering spool (46). This drop causes spool (46) to move to the right thereby connecting outlet pressure port (54) with control port (58) to cause the working pressure fluid to destroke the pump until the setting of compensator spring (124) is reached. In other words, compensator assembly (124) causes pump (10) to be destroked when the maximum set system pressure is attained by working pressure fluid whereas in the power limiting mode compensator metering spool (46) in conjunction with fixed orifice (32), the variable orifice created by ball (104) and seat (106) and fixed orifice (70) act to reduce the displacement of pump (10) to maintain a constant power output. An orifice (130) is inserted in line (92) to limit flow of control fluid at flow port (94) from flowing through bore (122) in seat (120) when cone (118) unseats.

Figure 2:
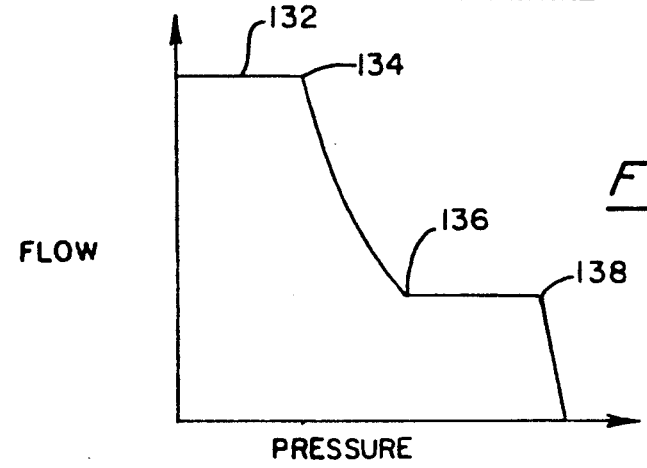
FIG. 2 is a diagram of a constant power maintained between two set flow rates.

Operation of power limiter control (40) to maintain a constant power output once the maximum power of the pump has been reached now will be described in conjunction with references to FIGS. 1 and 2. FIG. 2 represents a plot of the change in flow rate of working pressure fluid at the outlet (28) of pump (10) as the pressure of the working fluid changes. A maximum set flow rate for working pressure fluid output from pump (10) at outlet (28) is shown by horizontal line (132). This flow rate may be at the maximum displacement setting of pump (10). The pressure of the working fluid output from pump (10) is permitted to rise until it produces an amount of force equal to that set by spring (114) in combination with the pressure differential across ball (104) set by orifice (32) and the force applied to rod (108). This point (134) represents the pressure at maximum flow rate constituting the maximum power setting of the pump. When the working fluid attains this pressure, the force of the fluid acting on pin (108) plus the force created by the pressure differential across ball (104) is sufficient to overcome the force of spring (114) and cause ball (104) to begin lifting from seat (106). Initially, ball and seat (104 and 106) constitute a variable orifice which increases in size as the pressure of the working fluid output from pump (10) increases. Ball (104 and (106) function as a variable orifice in combination with the fixed orifice (70) in bore (68) of metering spool (46) until the flow through the variable orifice becomes unrestricted.

As stated above, point (134) denotes the point at which the pressure of the working fluid output from pump (10) becomes sufficient to begin to lift ball (104) from seat (106). When this occurs the pressure drop across compensator metering spool (46) caused by the flow of fluid through fixed orifice (70) becomes sufficient to shift spool (46) to the right to connect outlet pressure port (54) with control port (58). This enables working pressure fluid to enter bore (16) and act against control piston (14) to reduce the displacement of pump (10). The combination of fixed orifice (70) and variable orifice (104, 106) cause the displacement of pump (10) to be reduced as the pressure of that fluid increases in such a way that the power output from pump (10) remains substantially constant until the flow and pressure of the working fluid reaches point (136) in FIG. 2. At this point, compensator metering spool (46) controlled by the pressure differential across orifice (32) maintains a constant flow for the output of pump (10) until the pressure of the working fluid exceeds the pressure setting of compensator cone and spring (118 and 124) depicted as point (138) on the diagram of FIG. 2.

From the above, it maybe seen that the power limiter control (40) of the present invention functions to keep the power output of pump (10) substantially constant after it has reached a set maximum power by monitoring system flow without regard to the displacement setting of the pump control to accommodate different operating conditions or pressure requirements within a hydraulic system.

Since certain changes may be made to the above described structure and method without departing from the scope of the invention herein, it is intended that all matter contained in the description thereof or shown in the accompanying drawings shall be interpreted as illustrative and not in a limiting sense.

We claim:

1. A power limiter control for a variable displacement pressure compensated axial piston pump having an inlet and an outlet, a fixed orifice in said outlet for establishing a pressure differential proportional to outlet flow for the pump, a movable swash plate and a movable control piston attached to said swash plate for setting the displacement of the pump movable between a first control position of maximum pump displacement and a second control position of minimum pump displacement and spring means for spring biasing said control piston toward said first position which comprises:

a housing having a first bore for receiving a compensator metering piston, a tank port adapted to be connected to tank which opens into said first bore, an outlet pressure port adapted to be placed in fluid communication with the outlet of said pump which opens into said first bore, and a control port adapted to be connected to said control piston which opens into said first bore;

a compensator metering spool slideably received within said first bore having a metering land and movable between a first spool position in which said outlet pressure port is in fluid communication with said control port such that outlet pressure fluid is directed to said control piston to move said control piston toward said second control position, a second spool position in which said tank port is in fluid communication with said control port such that pressure fluid is drained from said control piston to enable said spring means to bias said control piston toward said first control position and an intermediate position in which said control port is blocked by said land;

compensator spring means for biasing said compensator metering spool toward said second spool position mounted in said housing;

a flow port formed in said housing in fluid communication with the downstream side of said fixed orifice and with said metering spool;

a first fixed orifice in fluid communication with said outlet pressure port and said flow port which creates a first pressure differential across said metering spool which opposes the force of said compensator spring means to establish a minimum flow setting when said pump is operating;

a pressure responsive valve in fluid communication with said first fixed orifice and said flow port movable between a closed valve position in which fluid flow between said outlet pressure port and said flow port is prevented, a fully open valve position in which maximum fluid flow between said outlet pressure port and said flow port occurs such that said metering spool is exposed to the entire pressure differential across said fixed orifice in said outlet port and intermediate positions between said closed position and said fully open valve position;

second spring means for biasing said pressure responsive valve toward said closed valve position said spring means being set to maintain said pressure responsive valve in said closed position until said outlet pressure reaches a set maximum for said outlet pressure fluid at maximum set flow;

wherein said pressure responsive valve means moves to said intermediate positions when said outlet pressure reaches said maximum set pressure to modulate fluid flow between said outlet pressure port and said flow port to modulate the pressure differential across said metering spool to cause said metering spool to move between said first and second spool positions to move said control piston between said first and second control positions to thereby cause pump displacement to vary proportionally to outlet pressure to maintain a constant power output from said pump; and pressure compensator means in fluid communication with said first fixed orifice to limit the maximum pressure of the fluid in said outlet.

2. The power limiter control of claim 1 further comprising a fixed orifice interposed between said flow port and said pressure compensator means to prevent fluid in said flow port from flowing to said pressure compensator when said compensator is operating to reduce the displacement of said pump.

* * * * *